US007883290B1

(12) United States Patent
Ross et al.

(10) Patent No.: US 7,883,290 B1
(45) Date of Patent: Feb. 8, 2011

(54) MANHOLE SECURITY BARRIER

(75) Inventors: Brenda Ross, 81636 Impala Dr., La Quinta, CA (US) 92253; David Ross, La Quinta, CA (US)

(73) Assignee: Brenda Ross, La Quinta, CA (US)

( * ) Notice: Subject to any disclaimer, the term of this patent is extended or adjusted under 35 U.S.C. 154(b) by 0 days.

(21) Appl. No.: 12/102,399

(22) Filed: Apr. 14, 2008

(51) Int. Cl.
*E02D 29/14* (2006.01)
*E03F 5/08* (2006.01)

(52) U.S. Cl. ..... 404/25; 52/20; 210/163

(58) Field of Classification Search ..... 404/25, 404/26; 52/20; 137/371; 210/163, 164, 210/170.01, 170.03, 170.05, 97, 131
See application file for complete search history.

(56) References Cited

U.S. PATENT DOCUMENTS

| | | | | | |
|---|---|---|---|---|---|
| 822,562 | A | | 6/1906 | Tucker | |
| 845,182 | A | | 2/1907 | Letts | |
| 1,287,290 | A | | 12/1918 | Golden | |
| 2,363,567 | A | | 11/1944 | Blakeman | |
| 4,158,515 | A | * | 6/1979 | Helms | 404/72 |
| 4,175,781 | A | | 11/1979 | Dumortier | |
| 4,273,467 | A | | 6/1981 | Cronk | |
| 4,279,356 | A | * | 7/1981 | Amorese et al. | 220/314 |
| 4,650,365 | A | * | 3/1987 | Runnels | 404/25 |
| 4,751,799 | A | * | 6/1988 | Ditcher et al. | 52/21 |
| 4,957,389 | A | | 9/1990 | Neathery | |
| 4,964,755 | A | | 10/1990 | Lewis et al. | |
| 5,240,346 | A | * | 8/1993 | Yin | 404/25 |
| 5,299,884 | A | * | 4/1994 | Westhoff et al. | 404/25 |
| 5,328,291 | A | * | 7/1994 | Wisniewski | 404/2 |
| 5,382,113 | A | * | 1/1995 | Chilton et al. | 404/25 |
| 5,431,553 | A | * | 7/1995 | Topf, Jr. | 425/11 |
| 5,540,411 | A | | 7/1996 | Strickland | |
| 5,611,640 | A | | 3/1997 | Bowman | |
| 5,697,729 | A | | 12/1997 | Bowman | |
| 5,827,007 | A | | 10/1998 | Barton et al. | |
| 5,944,442 | A | | 8/1999 | Rousch et al. | |
| 5,951,200 | A | | 9/1999 | Barton | |
| 5,957,618 | A | | 9/1999 | Sims et al. | |
| 5,966,876 | A | * | 10/1999 | Neathery et al. | 52/20 |
| 5,979,117 | A | | 11/1999 | Fuller | |

(Continued)

OTHER PUBLICATIONS

Sealing Systems Incorporated, Stainless Steel Inserts, http://www.ssisealingsystems.com/stainlesssteelinserts.htm (2 pages) (Jan. 31, 2008).

(Continued)

*Primary Examiner*—Thomas B Will
*Assistant Examiner*—Abigail A Risic
(74) *Attorney, Agent, or Firm*—Boyle Fredrickson, S.C.

(57) ABSTRACT

A manhole barrier system configured to prevent unauthorized access or dumping or removal of materials into manholes is provided. The manhole barrier system includes a substantially hollow sub-ring configured to be secured to the inside wall of the manhole, preferably using a layer of adhesive, and to receive a pan configured to serve as a barrier therein. The pan may be secured to the sub-ring by way of circumferentially spaced locking assemblies. The locking assemblies are further configured to allow for a limited amount of play between the pan and the sub-ring such that water trapped in the manhole may be allowed to flow upwardly out of the manhole.

33 Claims, 9 Drawing Sheets

U.S. PATENT DOCUMENTS

| | | | | |
|---|---|---|---|---|
| 6,435,763 | B1 | 8/2002 | Sakane et al. | |
| 6,464,425 | B1 | 10/2002 | Closkey | |
| 6,550,294 | B2 | 4/2003 | Garguilo | |
| 6,739,796 | B1 | 5/2004 | Del Nero et al. | |
| 6,743,088 | B2 | 6/2004 | Closkey | |
| 6,854,922 | B1 * | 2/2005 | Nicks | 404/25 |
| 7,153,057 | B1 | 12/2006 | Lucas | |
| 7,201,534 | B2 | 4/2007 | Dennis | |
| 7,361,834 | B1 * | 4/2008 | Trangsrud et al. | 174/66 |
| 2007/0059094 | A1 * | 3/2007 | He | 404/25 |

OTHER PUBLICATIONS

InflowShield, Durable Stainless Steel Manhole Cover Inserts, http://www.inflowshield.com (2 pages) (Jan. 31, 2008).

FRW Industries, TAPS Odor Control Air Scrubbers, http://www.frwindustries.com (1 page) (Jan. 31, 2008).

Sealing Systems, Inc., Stainless Steel Manhole Cover Inserts and No Flow Manhole Dish, http://www.idswater.com/water/us/sealing_systems/manhole_inserts/ (2 pages) (Jan. 31, 2008).

* cited by examiner

MANHOLE SECURITY BARRIER

BACKGROUND OF THE INVENTION

1. Field of the Invention

The invention generally relates to manholes and barrier systems for manholes. More particularly, the invention relates to a barrier security system configured to be used with any existing or new manhole to prevent the dumping of unwanted or hazardous materials into the manholes or other unauthorized access to manholes while enabling the release of water or other liquids therefrom.

2. Discussion of the Related Art

Manholes are commonly utilized as underground utility access points for performing repair, upgrading, and maintenance on underground or otherwise buried public utility services such as sewers, telephone, electricity, cable, fiber optics, storm drains, gas lines, steam lines and other similar facilities. Manholes are typically found in urban areas and are usually located within public and private easements, public right of way, and other access rights that allow work on the facilities. Manholes exist within public access areas including existing streets and sidewalks or other surface structures. Manholes generally comprise an access hole at street and/or ground level and an access shaft or riser extending upwardly from the manhole diameter transition section, normally referred as the cone, to the ring and cover. They may include ladders, stairs or other mechanisms that permit utility workers to descend down the access shaft, however where confined space entry requirements govern the access, the workers are lowered by a cable into the manhole and have protective clothing and breathing apparatus. A manhole cover, usually a metal disc or other shape and material, is typically placed over the manhole to prevent accidental or otherwise unauthorized access to the manhole.

Unauthorized access to a manhole can result in theft and illegal dumping of debris and grease into the sewer. Commercial grease haulers typically have trucks capable of carrying 3,000 to 4,000 gallons of grease collected from grease traps and grease interceptors from restaurants and other food service facilities. To cut costs and maximize profits, disreputable commercial grease haulers remove the existing manhole cover and dump the collected grease down the manhole rather than disposing of the grease properly at an authorized disposal site. As the grease flows down the manhole and through the associated pipes, it cools and congeals, collecting on roots and other debris or obstructions in the sewer. As such, the grease forms a blockage, inhibiting or even preventing the natural flow of sewage therethrough and results in backup and sewer overflow. In addition, other hazardous materials are capable of being disposed of through manholes, thereby creating a variety of environmental hazards.

Manhole security systems are desired for other reasons as well. For instance, sewers and the like, regrettably, pose an attractive point of access and hiding place for criminals or even terrorists and their wares. Still other unauthorized access to manholes include the removal or theft of wiring, cable, pipes, and other materials of value A variety of manhole security systems have been developed for preventing unauthorized access to existing manholes. Such security systems typically utilize an insert configured to be coupled to a lip of the manhole ring by being hooked under or otherwise latched thereto. The insert serves to provide a barrier to prevent the dumping of liquids into the manhole. However, a large number of existing manholes do not have a lip on the ring of the manhole. Accordingly, existing security systems are incapable of being used with manhole rings of this type. Existing security systems also must be removed for street improvements and thus do not remain in place to catch construction debris.

In addition, prior systems generally require relatively expensive and time-consuming drilling and/or bolting operations in order to install the inserts in the manhole. Other prior systems have utilized intricate and costly mechanisms that corrode over time.

Prior designs at least essentially completely sealed the manhole, thereby preventing release of sewage that would otherwise exit from the sewer by the hydraulic lifting of the manhole cover in a back-up situation. Without the capability of exiting through the manhole, sewage is capable of backing up into homes and businesses, resulting in expensive clean-up, restoration, and replacement of damaged property.

Prior designs utilize the existing ring and cover for locking. The ring and cover are removed during street repaving and construction to allow for the ring to be raised to the new street level, resulting in an unprotected opening in the manhole allowing construction debris enter the system and cause a sewer blockage The need therefore exists to provide a manhole security system that is relatively simple to maintain and is robust enough to withstand the rigors associated with operation of such systems.

The need also exists for manhole security system that can be quickly and efficiently assembled and maintained.

Further, the need also exists for a manhole security system that may be installed on a variety of existing manhole structures such as those having a lip as well as those without a lip.

Further, the need exist for a manhole security system that can be installed below the existing ring and cover prior to construction and remain installed in the manhole after completion of construction to protect against future dumping. Such a design would provide continuous protection from blockages and eliminate the potential for the need for expensive confined space entry to remove construction debris.

SUMMARY OF THE INVENTION

In accordance with a first aspect of the invention, at least one of the above-identified needs is met by providing a manhole security system that has a relatively simple design and that is configured to be used with a variety of existing manhole openings of various shapes and sizes. The security system generally provides a barrier for preventing unauthorized access to the manhole. Further, the security system provides a locking assembly that may be quickly and easily removed by an authorized operator but that also serves to deter unauthorized operators from tampering therewith.

In one embodiment, the sub-ring of the present invention comprises of two segments each with an upper and lower portion separated by an inwardly disposed lip circumferentially disposed thereon and adapted to receive a portion of the pan thereon. The pan serves as a barrier to prevent unauthorized access to or dumping of liquids and materials into the manhole as well as removal of materials from the manhole. At least one locking assembly is provided for securing the pan to the sub-ring. First and second locking assemblies may be provided in a circumferentially spaced relationship. In addition, the locking assemblies may be configured to allow for a limited amount of play between the pan and the sub-ring such that the pan may be lifted slightly therefrom to allow for the flow of water and other liquids out of the manhole in a back-up situation. Further, the locking assemblies are provided to discourage unauthorized persons from tampering with or otherwise removing the pan.

In one embodiment, the system of the present invention includes a substantially hollow sub-ring configured to be coupled to the inner surface of an existing manhole and configured to receive a pan therein. Accordingly, the pan may likewise have a lipped surface configured to be supported on the lip of the sub-ring.

In another embodiment, the pan includes at least one slot on the lipped surface thereof that is substantially aligned with a hole in the lipped surface of the sub-ring. The slot of the pan and hole of the sub-ring are configured to receive a locking assembly configured to secure the pan and sub-ring to one another. In one embodiment, the pan and sub-ring include a second slot and hole respectively for receiving a second locking assembly.

In one embodiment, the first locking assembly comprises an eye bolt secured to the sub-ring and such that the slot in the pan can be placed over the eye bolt and rest on the sub ring. A padlock or similar locking device is locked through the eye bolt so that the pan cannot be removed. The bolt preferably comprises a partially threaded shaft for receiving a fastener on the threaded portion thereof. The non-threaded portion prevents the fastener from being threaded all the way to the lipped surface of the sub-ring. Thus, a limited amount of play remains such that the pan may be lifted slightly before the fastener, which acts as a stop, abuts the lip of the sub-ring.

In one embodiment, both the first and second locking assemblies may be identical. Alternatively, the second locking assembly may comprise a protrusion extending from the sidewalls of the pan to a point below the lip of the sub-ring such that the protrusion serves as an abutting surface or stop therewith when the pan is lifted.

In another embodiment, the first and/or second locking assemblies may comprise a t-lock inserted through the hole of the pan and the slot of the sub-ring. When the t-lock is in its locked position, the t-shaped protrusion thereof is substantially perpendicular to the slot of the sub-ring. When in the unlocked position, the t-lock is substantially aligned with the slot in the sub-ring and the pan may be lifted and remove sliding the t-shaped protrusion through the sub-ring.

In yet another embodiment, the first and/or second locking assemblies may comprise a removable lock inserted through a vertical wall of the pan at a position beneath the lip of the sub-ring such that a limited amount of play between the pan and the sub-ring is preserved. The removable lock includes a receiver for receiving a key and a pin extending horizontally therefrom through a hole in the vertical wall of the pan. The pin serves as a stop or an abutment to the lip of the sub-ring when the pan is lifted such that the pan may not be removed therefrom. When the lock is unlocked, the pin is aligned such that it may be removed from the hole in the vertical sidewall of the pan. Accordingly, the entire removable lock may be removed, thereby allowing for removal of the pan.

In another embodiment of the present invention, a first and/or a second locking assembly may comprise a hasp lock hingedly coupled to the inside of the vertical wall of the pan. The hasp lock preferably comprises a ring fixed to the inner sidewall and a plate having a slot for receiving the ring therethrough. A pin projects horizontally through a hole in the vertical sidewall of the pan from the back side of the plate to serve as a stop or an abutment to the lip of the sub-ring when the pan is lifted. A padlock is secured to the ring of the hasp lock to lock the pan in place. To remove the pan, the padlock is simply unlocked such that the plate may freely rotate about a horizontal axis thereby pulling the pin from the hole in the vertical sidewall. Accordingly, the pan may be freely removed from the sub-ring.

The sub-ring of the present invention may be secured to the manhole in a variety of ways. In one embodiment, the sub-ring is coupled to the inner wall of the manhole at a point below the existing cast-iron ring thereof. Accordingly, during repairs to the surrounding street or sidewalk, the barrier system of the present invention does not need to be removed along with the cast-iron ring of manhole and remains in place to catch debris. Alternatively, the sub-ring may be coupled to the cast-iron ring directly where raising the ring is not anticipated. The lipped surface of the sub-ring may be coupled to a manhole having a lip or without a lip by way of an adhesive such as an epoxy or other similar such adhesives or bonding agents.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

A manhole security barrier system constructed in accordance with a preferred embodiment of the invention is described below in connection with a standard manhole. It should be understood that the illustrated assembly and others constructed in accordance with the invention could be used with a variety of different manholes, including those with or without a lip.

Figure 1:
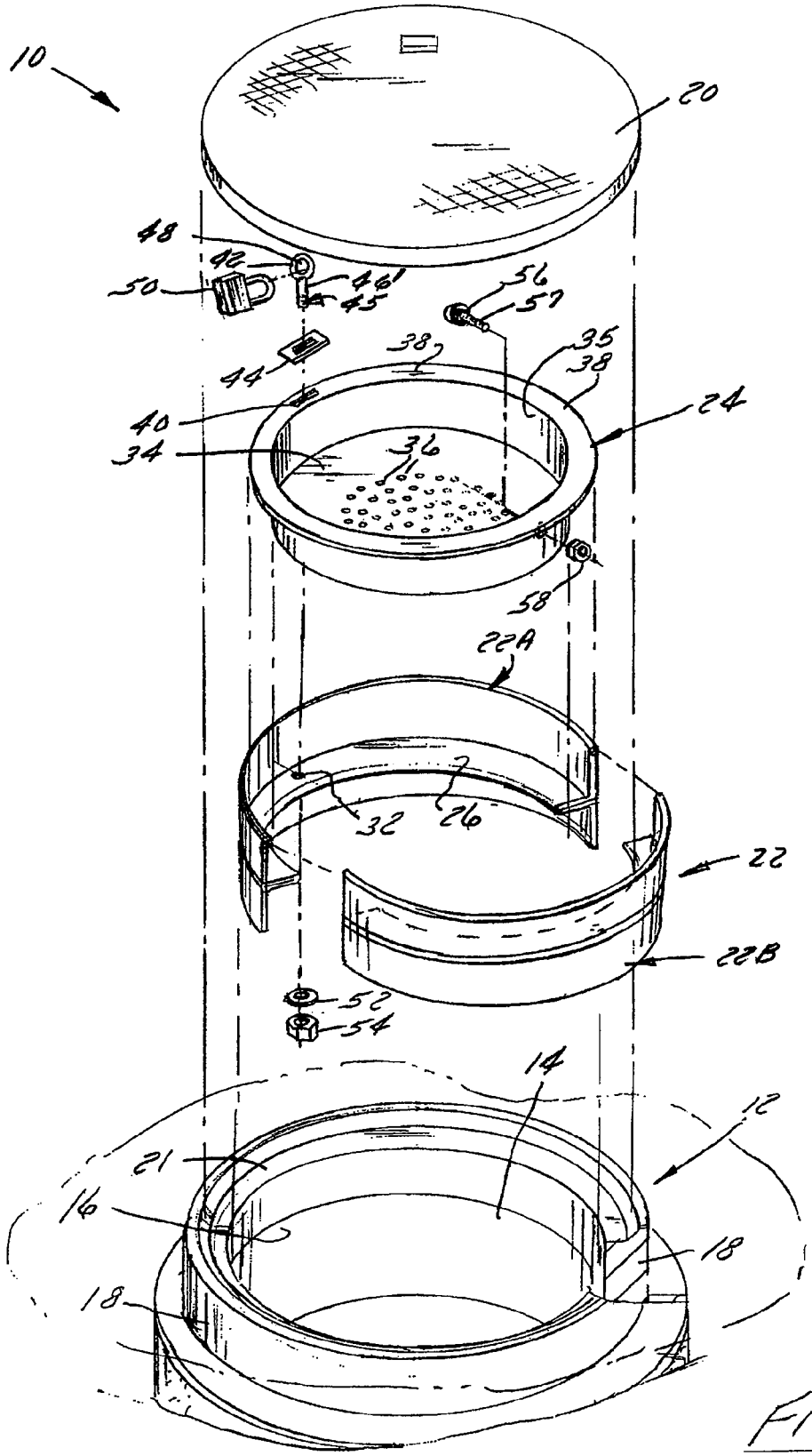
FIG. 1 is an exploded perspective view of one embodiment of the manhole security barrier system of the present invention.
Figure 2A:
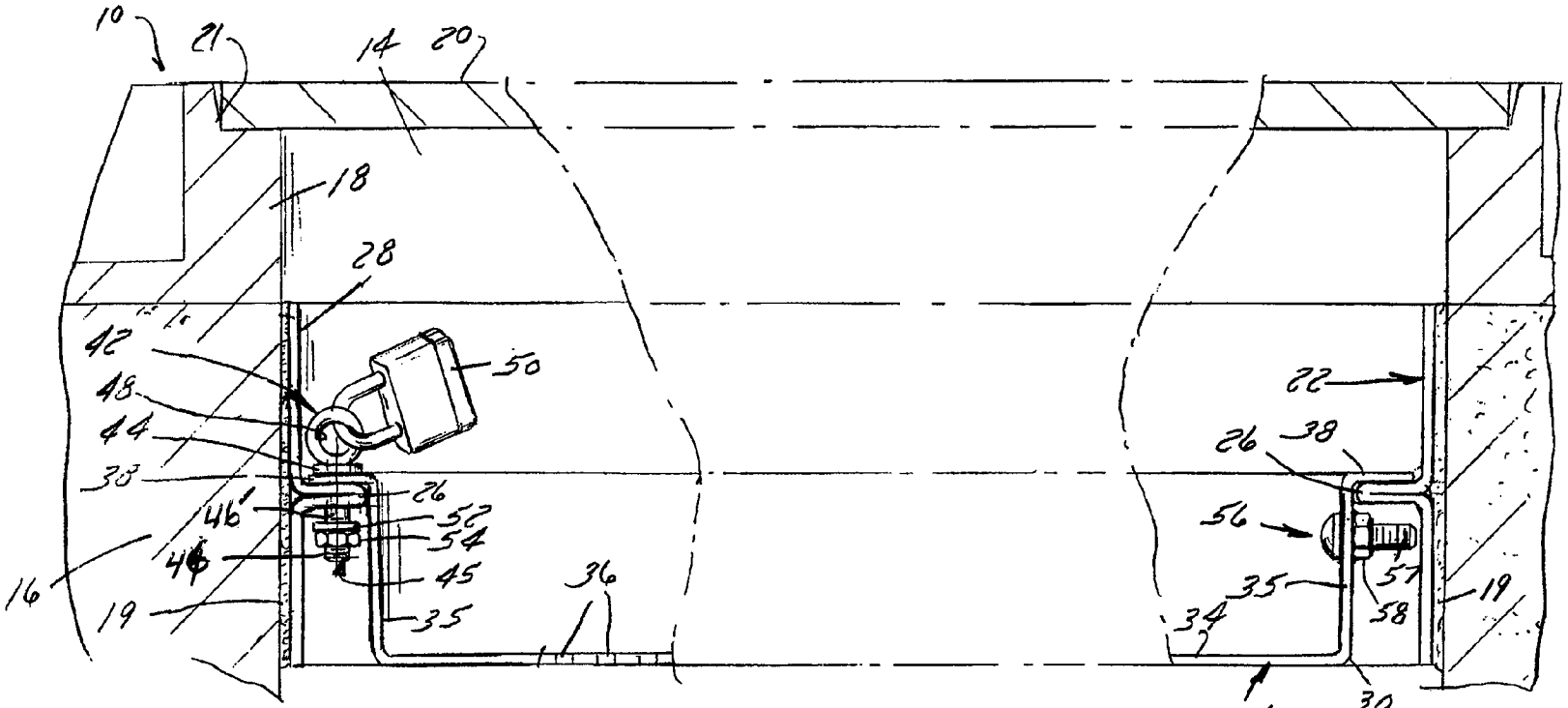
FIG. 2A is a sectional elevation view of the manhole security barrier system of FIG. 1.
Figure 2C:
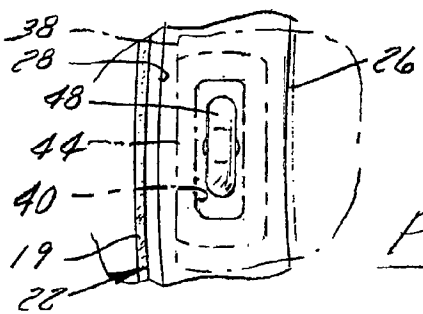
FIG. 2C is a top plan view of a locking mechanism of the manhole security barrier system of FIG. 1.

Referring initially to FIGS. 1-2C, a manhole security barrier system 10 for preventing unauthorized access to the manhole is coupled to the interior of a standard manhole 12. Manhole 12 includes an access hole 14 providing access to a cylindrical downwardly extending access shaft 16 for maintenance or utility workers. The manholes may include ladders, stairs or other mechanisms (not shown) that permit utility workers to descend down the access shaft, however where confined space entry requirements govern the access, the workers are lowered by a cable into the manhole and have protective clothing and breathing apparatus. The confined space entry is provided for safely allowing the worker to descend down the access shaft or riser 16 for performing routine maintenance on a variety of utilities such as sewers, telephone, cable, fiber optics, electricity, storm drains, steam lines, gas lines, and other similar facilities. The typical manhole 12 is fitted with a frame or ring 18 circumferentially secured around the access hole 14. The ring or frame 18 typically is formed from cast iron and may be either smooth on its inner surface as illustrated as or may have an inwardly facing shoulder or flange at its lower end. A manhole cover 20, seated in a notch 21 in ring 18, serves to prevent accidental or unauthorized access to the manhole 12.

The manhole security barrier system 10 of the preferred embodiments of present invention includes a sub-ring 22 and a pan 24. Both the sub-ring 22 and the pan 24 preferably are formed from stamped stainless steel, but components formed in whole or in part from other materials and/or by other processes could be employed.

Unlike prior systems that were specially adapted for use only with manhole rings having inwardly projecting lips or flanges, inclusion of the sub-ring 22 in system 10 permits the system 10 to be used with any type of manhole frame. It also is configured to be mounted to the frame 18 and/or the underlying riser 16 quickly and easily, preferably using a layer 19 of adhesive such as epoxy between the outer perimeter of the sub-ring 22 and the inner perimeter of the manhole 16 and/or frame 18. The preferred adhesive should be sufficiently strong to hold the sub-ring 22 and the supported pan 24 in place when subjected to vibrations from passing street traffic as well the imposition of weight that may be imparted thereon by people standing on the pan 24 and/or by the piling of water or debris on the barrier system 10. It should also be impervious to water, grease, and other chemicals commonly found in or around sewers. The currently preferred adhesive is a two-part epoxy, and, more preferably, is the same as or functionally similar to that used by the State of California to bond center-lane reflectors on highways. The preferred epoxy may comprise a carbon filament epoxy having a viscosity similar to that of mortar such that it may be applied with a trowel and having a setup time of between ten and fifteen minutes. Other adhesives having similar characteristics are contemplated and may be used in practicing the present invention. The use of such an adhesive negates the need for complex and time-consuming drilling and fastening operations required of prior barrier systems. It also accommodates considerably greater tolerance in manhole frame shape and size than with prior systems. It also can be applied to either the cast-iron ring 18 or the underlying concrete quite easily, requiring only that loose flakes or scales and grease be removed prior to its application. It can also remain during construction where other security systems must be removed to repave, overlay or other street improvements.

In the present embodiment, the sub-ring 22 is mounted to the shaft 16 beneath, preferably immediately beneath, the frame 18. Mounting the sub-ring in this location permits repairs to be made to the area surrounding the manhole 12, including the removal of the frame 18 and/or the adding of street layers above the current street level, without removing the sub-ring 22. In order to permit mounting of the sub-ring 22 in this location, the outer perimeter 21 is preferably cylindrical rather than having an outwardly-extending flange or shoulder.

The sub-ring 22 may be formed as one contiguous piece or, alternatively, may be segmented into two or more arcuate sections 22A and 22B as best seen in FIGS. 1 and 2A. Typically, the segmented sub-ring 22 will be pre-fabricated into a diameter that is smaller than the diameter of the manhole 12. During installation, each segment 22A, 22B of the sub-ring 22 is individually lowered through the access hole 14 of manhole 12 and then pressed against the inside wall of riser shaft 16 and affixed thereto with an adhesive thereto. Once affixed, the segments of sub-ring 22 will remain independent of one another, and a gap 23A, 23B (FIGS. 1 and 2B), on each side thereof may result. If desired, the gap(s) between the sections 22A and 22B can be filed with adhesive to produce a contiguous surface. If the diameter of the manhole opening is large additional sections of sub-ring 22 can be added.

The two piece sub-ring design allows it to be slipped past the existing cast-iron ring 18 and mounted below it. If the sub-ring 22 is installed below the existing cast-iron manhole ring 18, the existing concrete collar and manhole ring can be jackhammered and removed during a street resurfacing project, allowing the height of ring 18 to be adjusted upward to the new street level. The sub-ring 22 and pan 24 would have been installed prior to the pavement overlay work so that the pan 24 can catch any debris that could fall into the manhole 12 and potentially cause a blockage. This debris catching is a significant advantage of this embodiment of the invention because workmen typically are not allowed to enter the manholes to clean up the debris without following the confined space entry safety requirements. These requirements involve the lowering of the workmen from at tripod wearing breathing apparatus, which costs $1500 to $2000 for each entry. These costs are completely avoided using this embodiment of the invention.

The outer perimeter 21 of sub-ring 22 is shaped and dimensioned to match the inner perimeter of the adjacent portions of man-hole shaft 16 and, as such, will be circular in most instances. However, it is envisioned that rectangular, square, triangular or other shapes may be employed in some situations. Accordingly, pan 24 may likewise comprise a variety of shapes to correspond with the shape of sub-ring 22.

Sub-ring 22 of this embodiment includes an inwardly-disposed circumferential lip 26 for receiving pan 24. The lip 26 is disposed between an upper portion 28 and lower portion 30 of the sub-ring 22, but could be located at either the top or bottom of sub-ring 22. The lip 38 could be contiguous as shown or formed from a number of circumferentially spaced tabs. Further, sub-ring 22 includes a hole 32 extending through lip 26 for receiving a locking assembly detailed below. The lip 26 may be formed integrally with the remainder of sub-ring during the stamping process.

Pan 24 is designed to prevent the dumping of grease or other materials into manhole 12 or other unauthorized access while permitting rainwater or the like to flow into manhole and to permit sewage that is backing up into the sewer to flow upwardly past the pan 24. To this extent it may be thought of check valve that permits restricted flow in one direction and relatively unrestricted flow in the opposite direction. Preferably, it is mounted on the sub-ring 22 by one or more locking assemblies that permit quick and easy authorized access to the manhole 12. Toward these ends, pan 24 includes a bottom surface 34 and an outer peripheral wall 35 extending upwardly from the bottom surface 34 and terminating at an outwardly-extending flange or lip 38. Bottom surface 34 may include a number of apertures 36 therein for venting of gasses trapped in manhole 12 below the manhole security barrier system 10 of the present invention and for permitting storm water and the like to flow into the manhole 12 from above. Apertures 36 preferably have a diameter of no more than 1/16 of an inch. Preferably, the pan 24 of this embodiment includes twenty to thirty apertures 36 located in the center thereof. The holes 36 should not, however, be sufficient in number of diameter to permit grease or other relatively viscous fluids to flow rapidly into manhole 12 from above. Lip 38 is supported on lip 26 of sub-ring 22 such that pan 24 is received in the hollow portion of sub-ring 22 to provide a barrier such that unauthorized persons may not dump grease or other hazardous material down the manhole 12 or remove materials from the manhole. As discussed above, pan 24 preferably is secured to sub-ring 22 such that a limited amount of "play," i.e., vertical movement, is allowed between pan 24 and sub-ring 22 such that the pan 24 may be lifted slightly to allow water trapped in the access shaft 16 of manhole 12 to flow upwardly out of manhole 12.

As discussed briefly above, manhole security barrier system 10 of the present invention generally includes at least one locking assembly configured to secure pan 24 to sub-ring 22 so as to prevent unauthorized persons from removing pan 24 from manhole 12 while permitting relatively rapid and easy access to the manhole shaft 12 by authorized persons. Several non-mutually exclusive locking assemblies will now be described.

Figure 2B:
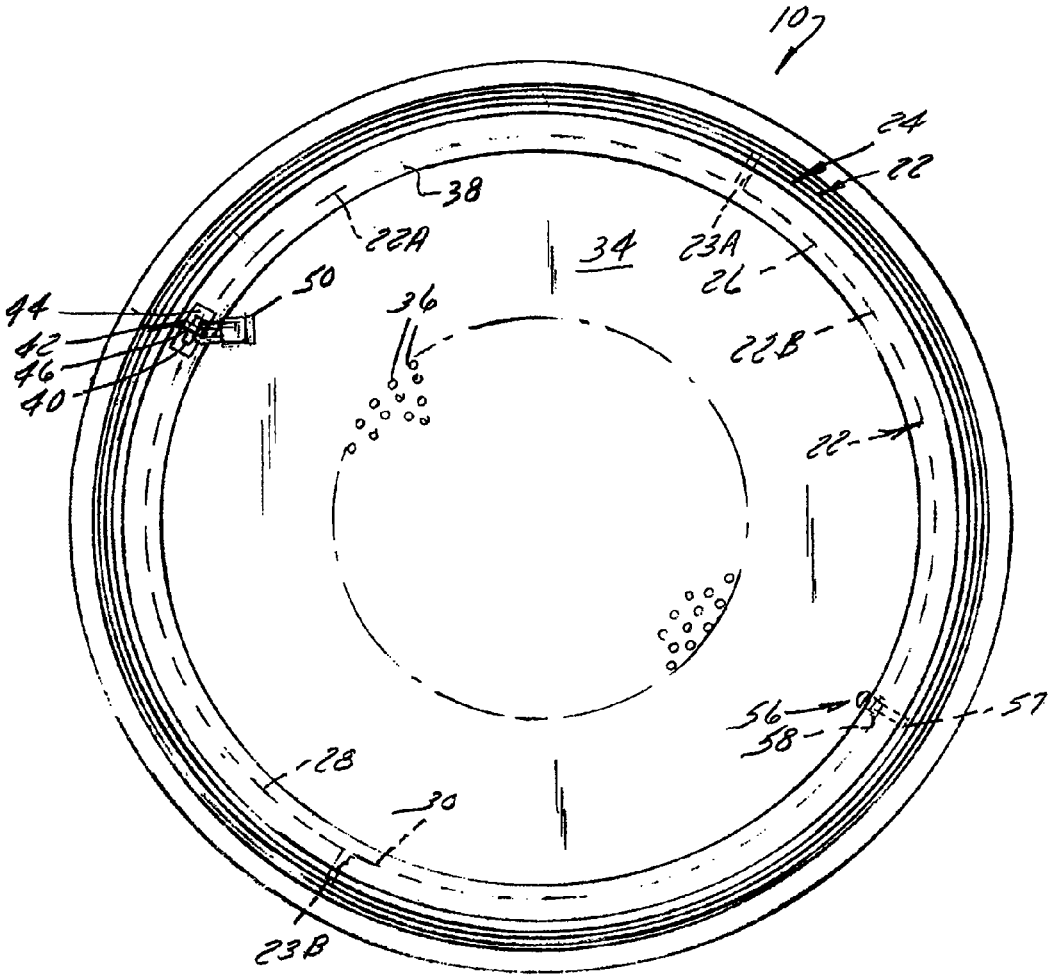
FIG. 2B is a top plan view of the manhole security barrier system of FIG. 1.

Referring first to FIGS. 2A-2C, lip 38 of pan 24 comprises a slot 40 disposed thereon for receiving a swiveling eye-bolt 42 therethrough. Slot 40 is formed through both the lip 38 and a reinforcing plate 44 mounted on the lip 38 in the vicinity thereof. The slot 40 can be aligned with the head 48 of eyebolt 42 formed in the flange 26 of the sub-ring 22. An eye-bolt 42, having a shaft 45, is inserted through a hole 32 in the flange 26 of the sub-ring 22, and a washer 52 and nut 54 are then mounted on a lower threaded portion 46 of the shaft 45. The pan slot 40 is aligned over eye-bolt 42 and lowered so that a head 48 of the eye-bolt 42 extends through slot 40. The eye-bolt 42 is then rotated so that the head 48 is at least generally perpendicular to the major axis of the slot 44 and locked in place with a padlock 50. At this time an unthreaded portion 46' of shaft 45 is located beneath the bottom of flange 26 such that a limited amount of space, preferably about 1/4" to 1/2", is provided between the threaded portion 46 and lip 26 of sub-ring 22. Accordingly, a limited amount of play is provided such that the pan 24 may be lifted slightly off of the sub-ring 22 to allow water or other such trapped fluids to flow upwardly out of manhole 12.

Accordingly, a limited amount of play is provided such that the pan 24 may be lifted slightly off of the sub-ring 22 to allow water or other such trapped fluids to flow upwardly out of manhole 12.

The manhole security system 10 of this embodiment of the present invention further includes a second locking assembly disposed 180 degrees from the first locking mechanism. In one embodiment, the second locking mechanism comprises a protrusion extending outwardly from the side wall 35 of the pan beneath the lip 26 of the sub-ring 22. The protrusion may, for instance, comprise a threaded bolt 56. Bolt 56 is generally horizontally inserted through a hole in the peripheral wall 35 of the pan 24 such that the shaft 57 thereof is disposed beneath lip 26 of sub-ring 22. Accordingly, the bottom surface of lip 26 provides a stop or an abutment surface for the bolt 56 when the pan is lifted, whereby pan 24 is prevented from being lifted away from sub-ring 22. Further, a nut 58 is threaded onto the shaft of bolt 56 to secure the bolt 56 in place.

Referring now to FIG. 2C in particular, the eye-bolt 42 is shown without padlock 50. When the padlock is removed, eye-bolt 42 can be rotated to be substantially aligned with slot 40 of pan 24 such that the pan 24 may be lifted past the eye-bolt 42 and away from the sub-ring. Further, as pan 24 is lifted, bolt 56 is allowed to be inclined substantially clear of lip 26 of sub-ring 22 such that removal of bolt 56 is not required to remove pan 24.

Figure 6:
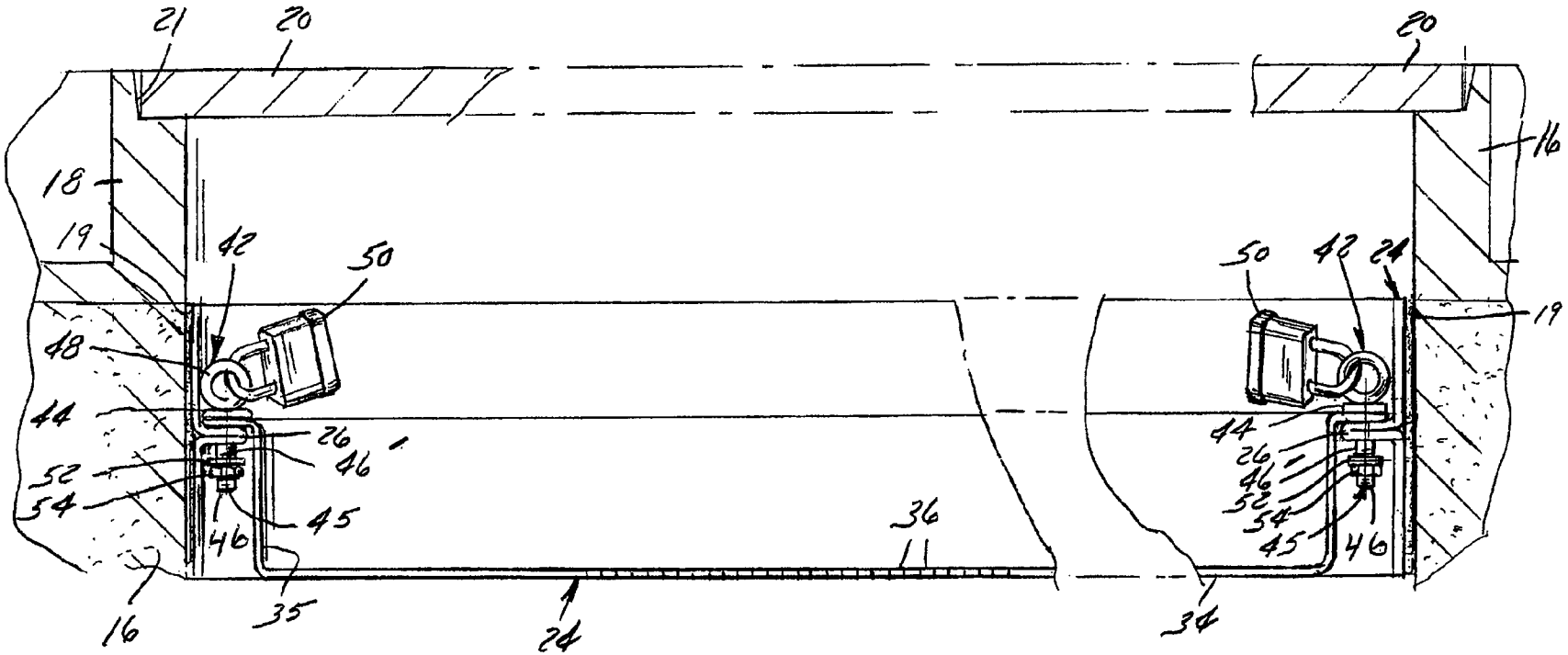
FIG. 6 is a sectional elevation view of a manhole security barrier system of the present invention having still another alternative locking mechanism.

Alternatively, as shown in FIG. 6, system 10 can be configured with a pair of identical locking mechanisms on either side thereof such that, to remove pan 24, both eye-bolts 42 must be rotated as described previously and locked with padlock 50.

Figure 3A:
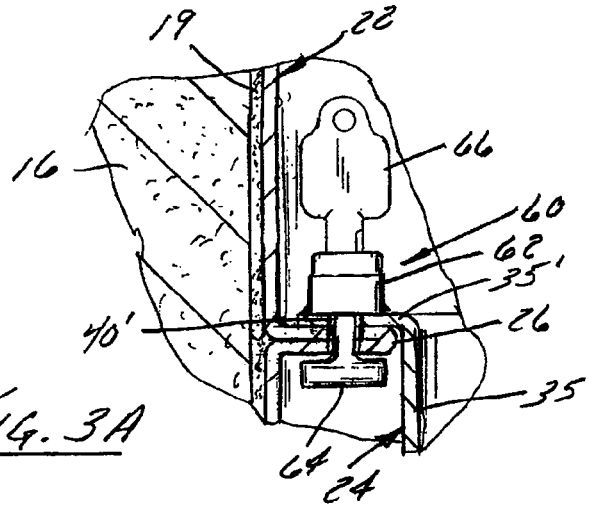
FIG. 3A is a partial elevation view of an alternative locking mechanism of the manhole security barrier system.
Figure 3B:
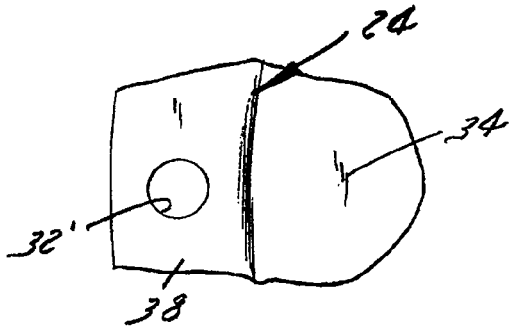
FIG. 3B is a top plan view of the hole of the pan of the manhole security barrier system of FIG. 3A.
Figure 3C:
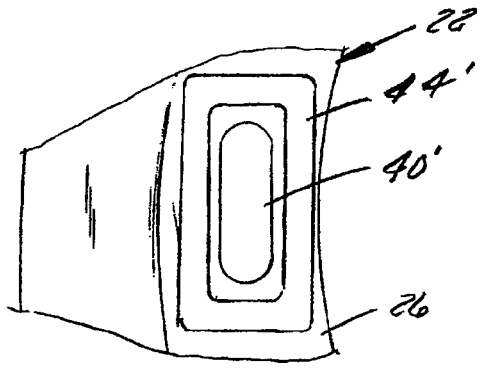
FIG. 3C is a top plan view of the slot of the sub-ring of the manhole security barrier system of FIG. 1.

Turning to FIGS. 3A-3C, an alternative embodiment of the locking mechanism of the system 10 of the present invention is shown wherein the locking mechanism comprises a t-lock 60 having a key receiver 62 and a t-shaped protrusion 64 extending downwardly therefrom and extending through a hole 32 in pan 24 and through a slot 40' in the lip 26 of sub-ring 22 to couple the pan 24 and sub-ring 22 to one another. Key receiver 62 is preferably welded or otherwise fixed to lip 38 of pan 24. When the t-lock 60 is in the locked position, the t-shaped protrusion is positioned to be perpendicular to slot 40' such that, when pan 24 is pulled upwardly, t-shaped protrusion 64 prevents its removal. To remove the pan, a key 66 is inserted into key receiver 62 to turn the t-shaped protrusion 64 such that it is substantially aligned with slot 40. Accordingly, pan 24 may be simply lifted upwardly for removal. When compared to the embodiment of FIG. 1-2C, the locking assembly of this embodiment offers the advantage of not requiring any assembly of the locking assembly during installation of the barrier system 10 or even as part of the locking process. The opportunity for loss of lock components is therefore eliminated.

In addition, system 10 may be configured such that both of the locking assemblies include t-lock 60, or alternatively, system 10 may utilize the horizontal bolt 56 as the second locking assembly thereof. As such, pan 24 may be freely lifted off of sub-ring 22 in the manner described previously after the t-shaped protrusion has been aligned with slot 40.

Figure 4:
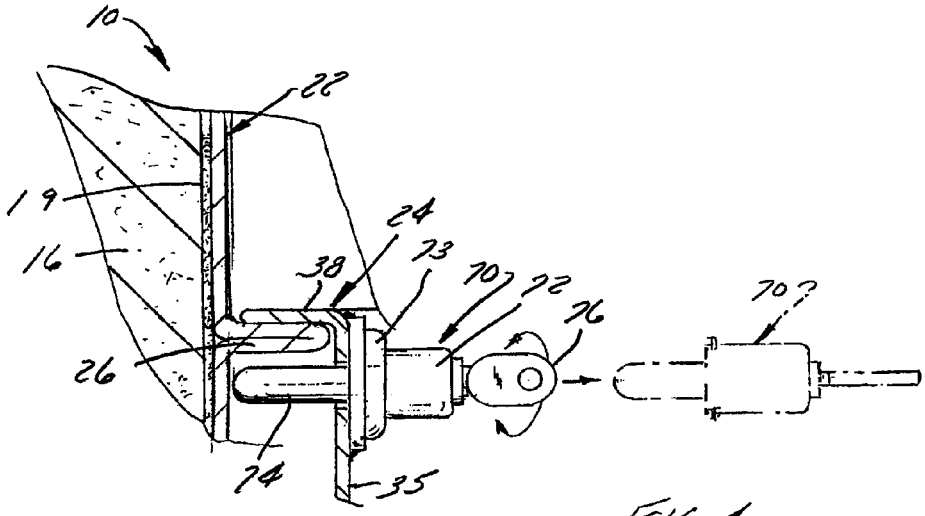
FIG. 4 is a sectional elevation view of a portion of an alternative locking mechanism of the present invention, showing the locking mechanism removed from the manhole security barrier system in phantom.

Referring now to FIG. 4, another embodiment of the locking assembly for system 10 of the present invention includes a horizontal removable locking assembly 70. Locking device 70 includes a key receiving portion 72 and a pin 74 that removably extends horizontally therefrom through a hole in sidewall 35 of pan 24 positioned below lip 26 of sub-ring 22. A reinforcement plate 73 is generally positioned between key receiver and the wall 35 of pan 24 beneath the lip 26 on sub-ring 22. Pin 74 is generally long enough such that it serves as a stop or an abutment for lip 26 when the pan is lifted and is positioned sufficiently beneath the lip 26 that a limited amount of play is provided between the pan 24 and sub-ring 22 to permit pan 24 to be lifted slightly as discussed previously. In operation, a key 76 may be inserted into key receiving portion 72 and turned to an unlocked position, whereby the entire locking device 70 may be freely removed. As such, pan 24 is free to be removed from sub-ring 22 as described previously. As with the other embodiments of system 10 of the present invention, the system 10 may include a pair of horizontal removable locking devices 70 disposed 180 degrees from one another, or alternatively, may include the horizontal bolt 56 as the second locking device as discussed previously.

Figure 5:
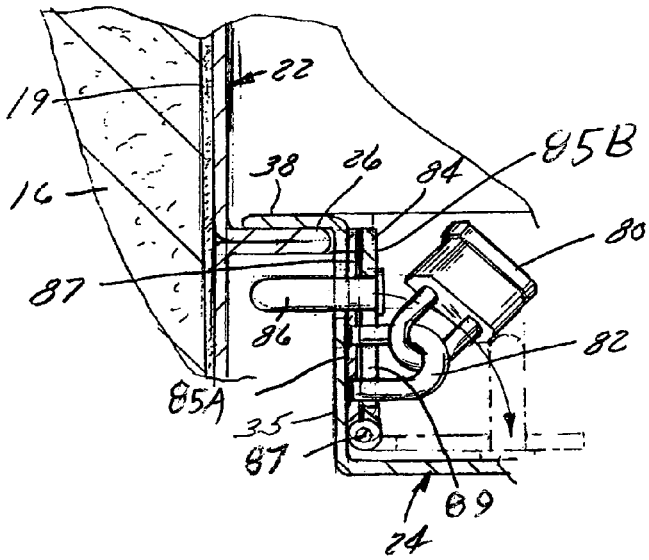
FIG. 5 is a sectional elevation view of a portion of still another alternative locking mechanism of the present invention, showing the locking mechanism in a locked position and the unlocked position being shown in phantom.

Turning to FIG. 5, yet another embodiment of the locking assembly usable with the barrier system 10 of the present invention includes a padlock 80 coupled to a U-shaped link 82 coupled to wall 35 of pan 24. A hasp 84 or similar such structure is includes a slot 85 through which link 82 is received. Specifically, a front plate 85A of the hasp 84 is coupled to the inner surface of wall 35 of pan 24 with a weld, rivet, epoxy, or other bonding system. A back plate 85B of the hasp 84 is pivotally attached to the front plate 85A by a pin 87. Another pin 86 is fixed to the front plate 85B of hasp 84 at the upper end of slot 85, extends through a slot 89 in the wall 35 of the pan 24, and is positioned below lip 26 of sub-ring 22 such that it serves as an abutting surface when pan 24 is lifted from sub-ring 22. As in the previous embodiments disclosed herein, pin 86 is positioned so as to provide a limited amount of play between pan 24 and sub-ring 22 such that pan 24 may be lifted slightly to release water or other fluids trapped in manhole 12. Accordingly, to remove pan 24, the padlock 80 is unlocked and removed such that the front plate 83B hasp 84 may be rotated about pin 87 to remove pin 86 from slot 89. As such, pan 24 may be freely lifted from manhole 12. As with previous embodiments, system 10 of the present invention may comprise a pair of similar such locking mechanisms disposed 180 degrees from one another, or alternatively, system 10 may include the horizontal bolt 56 as the second locking mechanism.

Figure 7:
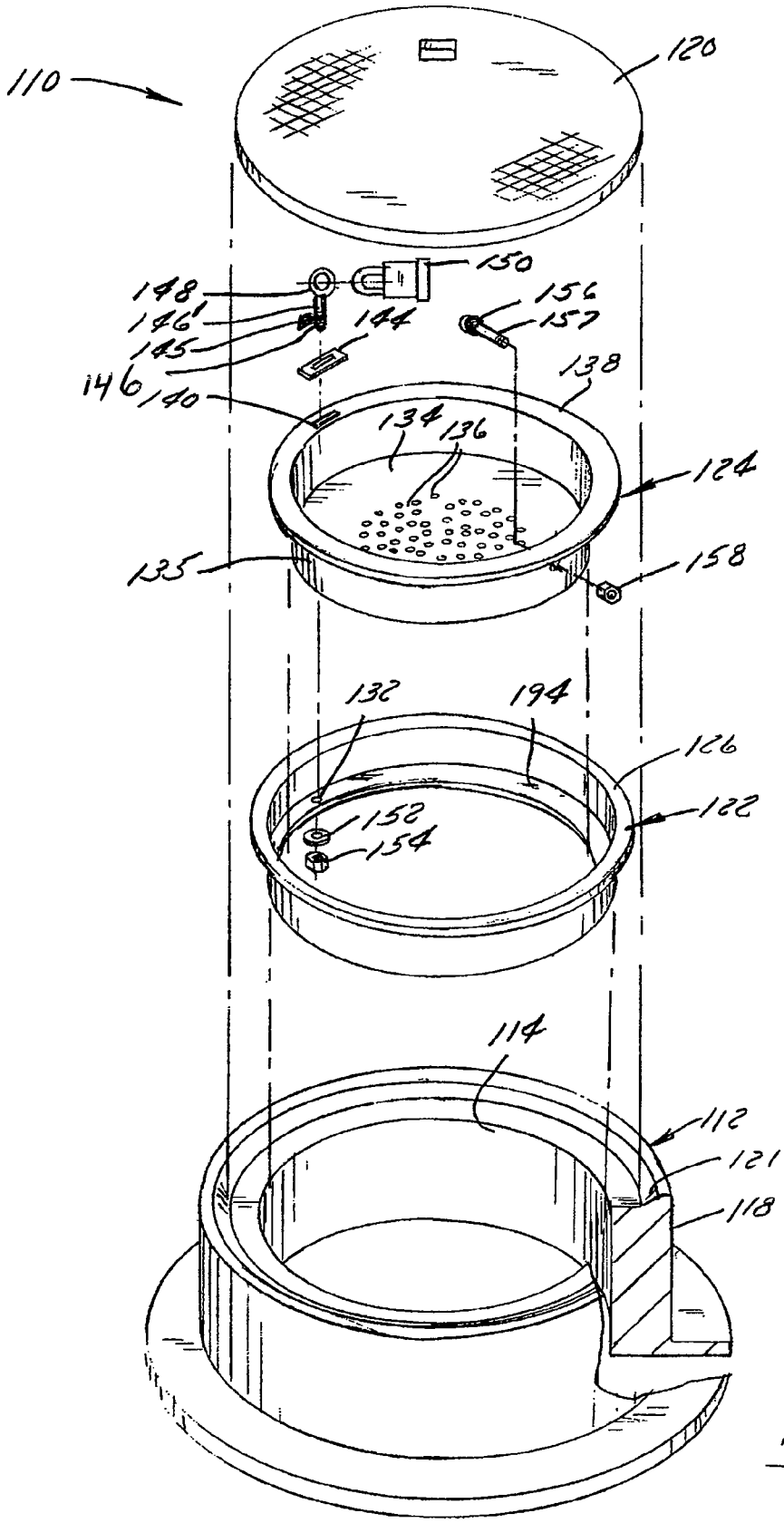
FIG. 7 is an exploded perspective view of another embodiment of the manhole security barrier system of the present invention.
Figure 8A:
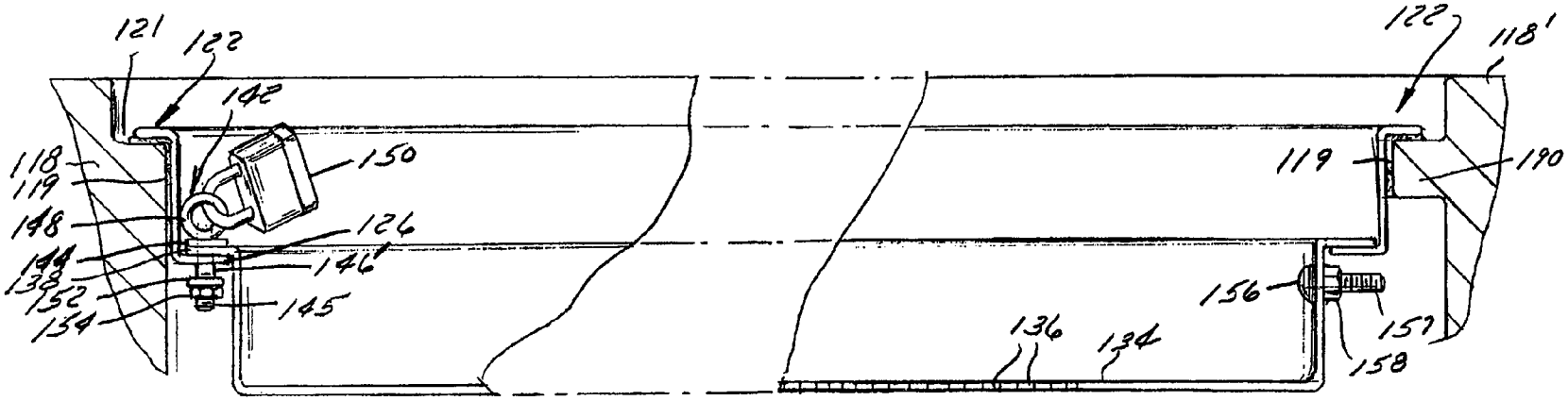
FIG. 8A is a sectional elevation view of the manhole security barrier system of FIG. 7.
Figure 8C:
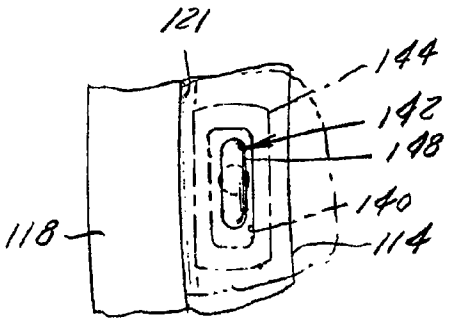
FIG. 8C is a top plan view of the locking mechanism of the manhole security barrier system of FIGS. 7-8B.
Figure 8B:
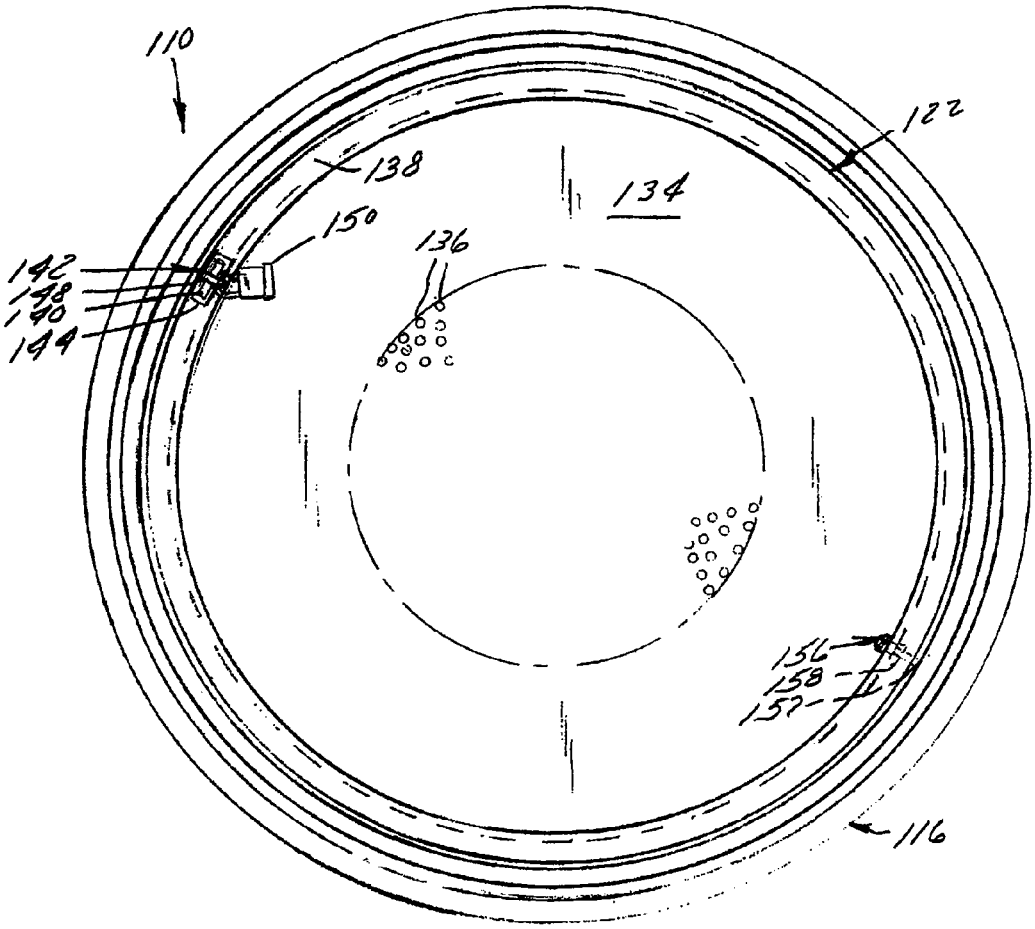
FIG. 8B is a top plan view of the manhole security barrier system of FIGS. 7 and 8A.

Turning now to FIGS. 7-8C, an alternative embodiment of the barrier system 110 of the present invention includes a sub-ring 122 configured to be coupled to the cast-iron ring 118 of manhole 112 rather than to the shaft 116 below the ring 118. Manhole 112 includes an access hole 114 at street level and an access shaft 116 extending downwardly therefrom. Sub-ring 122 of this embodiment is configured to be coupled to a ring 118 having an underlying lip 190 as is shown on the right-hand side of FIG. 8A or may be used with a ring 118' devoid of a lip as shown on the left-hand side of FIG. 8A. Sub-ring 122 of this embodiment differs conceptually from the sub-ring 22 of the first embodiment only in that it includes an upper outwardly-extending flange lip 192 configured to be coupled to the notch 121 of existing cast-iron ring 118 of manhole 112 and may be secured thereto by way of epoxy or similar such adhesive. Sub-ring 122 further includes a lower inwardly-extending lip 126 configured to receive a pan 124 thereon. Sub-ring 122 further includes a hole 132 in lip 126 thereof for receiving a locking mechanism therethrough.

Pan 124, like pan 24 of the first embodiment, includes a perforated bottom surface 134 and a peripheral wall 135 having an outwardly extending lip 138 that is configured to be secured to lip 126 of sub-ring 122. Lip 138 further includes a slot 140 therein configured to be substantially aligned with hole 132 of lip 126. Slot 140 is likewise configured to receive a locking mechanism therethrough for securing the sub-ring 122 to pan 124.

Pan 124 of this embodiment is secured to sub-ring 122 by way of an eye-bolt 142 having a circular head 148 and a downwardly-extending shaft 145 having a threaded portion 146 and a non-threaded portion 146'. The shaft 145 of eye-bolt 142 is inserted through the hole 132 in the sub-ring 122, and a washer 152 and nut 154 are mounted on the threaded portion 146. The slot 140 can be aligned with the head 148 of the eye-bolt 142 and the pan 124 lowered onto the sub-ring 122. The eye-bolt 142 can then be rotated so that the head 148 is at least generally perpendicular to the slot 144, and a padlock 150 fastened to the head 148 to secure the eye-bolt 142 in place. As before, non-threaded portion 146' of shaft 145 is configured to provide a limited amount of play between pan 124 and sub-ring 122 such that pan 124 may be lifted to allow the flow of water out of manhole 112.

A second locking assembly is provided 180 degrees from the first locking mechanism. Preferably, the second locking mechanism includes a bolt 156 having a shaft 157 horizontally inserted through pan 124 and is secured thereto by way of a nut 158 threaded thereon. Bolt 156 is positioned below lower lip 126 of sub-ring 122 so as to provide a stop or an abutment surface therewith when the pan is lifted.

When desired, pan 124 may be removed by removing padlock 150 and rotating eye-bolt 142 such that the slot 144 may lift past it. As such, pan 124 may be lifted on the side having eye-bolt 142 such that the opposing side may be pulled out and away from under lip 194 of sub-ring 122. Alternatively, the second locking assembly may comprise the same eye-bolt locking mechanism provided on the opposite side of the pan 124. As such, the 124 pan may be removed by unlocking eye-bolt 142 as discussed previously on both sides and lifting pan 124.

In addition, the alternative embodiment of the present invention may comprise any of the locking mechanisms discussed with respect to the first embodiment.

Although the best mode contemplated by the inventors of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments.

We claim:

1. A security barrier system for attachment to a manhole bordered by an outer ring a shaft extending downwardly therefrom, the barrier assembly comprising:

a sub-ring affixed to the manhole at or below the outer ring of the manhole, the sub-ring having a hole through a center thereof;

a pan at least partially covering the hole of the sub-ring and being secured to the sub-ring;

a manhole cover that is mounted on the outer ring of the manhole over the pan in a spaced apart relationship relative thereto; and a locking assembly that releasably locks the pan to the sub-ring, the locking assembly including a stop;

wherein the locking assembly, the manhole cover, the sub-ring, and the pan are configured such that, when the locking assembly is engaged to thereby lock the pan to the sub-ring and the manhole cover is mounted in place over the pan, a gap is formed between the sub-ring and the stop of the locking assembly such that the pan can move upwardly a limited amount with respect to the sub-ring by an amount, as defined by the gap, that is sufficient to allow for the liquids to flow from the manhole from below in a back-up situation.

2. The security barrier assembly of claim 1, wherein the sub-ring comprises (a) an outer wall having a shape generally matching the shape of the adjacent portion of the manhole; and (c) an inwardly-extending circumferentially disposed lip on an inner surface thereof.

3. The security barrier assembly of claim 2, wherein the pan includes an outwardly extending lip that is supported on the circumferentially disposed lip of the sub-ring.

4. The security barrier system of claim 3, wherein the sub-ring is mounted on the manhole beneath the outer ring and has an at least generally vertical outer surface.

5. The security barrier system of claim 3, wherein the sub-ring is mounted on the outer-ring of the manhole and includes an outwardly-extending flange supported in a notch of the outer ring.

6. The security barrier assembly of claim 3, wherein one of the lips has a slot and the other of the lips has a hole which is aligned with the slot, and wherein a portion of the locking assembly is rotatable so as to selectively be capable of passing through the slot.

7. The security barrier assembly of claim 6, wherein the locking assembly comprises, (a) a bolt having shaft comprising a threaded portion and a non-threaded portion inserted through the slot and hole to secure the pan to the sub-ring; and (b) a fastener threaded onto a threaded portion of the shaft to secure the bolt between the pan and the sub-ring, the fastener serving as the stop.

8. The security barrier assembly of claim 6, wherein the pan includes a second slot and the sub-ring includes a second hole substantially aligned with the second slot for receiving a second locking assembly.

9. The security barrier assembly of claim 5, wherein the pan includes an aperture through a sidewall thereof for receiving a second locking assembly.

10. The security barrier assembly of claim 9, wherein the second locking assembly comprises, a horizontal stop horizontally inserted through the aperture of the pan and is positioned beneath a surface of the sub-ring so as to serve as an abutment surface therewith.

11. The security barrier assembly of claim 1, wherein the pan comprises a plurality of apertures in the bottom surface thereof for the passage of fluids therethrough.

12. The security barrier assembly of claim 1, wherein the sub-ring is affixed to an inner wall of the manhole below the outer ring thereof and has a substantially vertical outer surface.

13. The security barrier assembly of claim 12, wherein the sub-ring is formed from a plurality of arcuate segments that are mounted in the manhole independently of one another.

14. The security barrier assembly of claim 1, wherein the sub-ring is affixed to the outer ring of the manhole and has an outwardly extending lip that is supported on a notch in the outer ring.

15. The security barrier assembly of claim 1, wherein the pan includes a hole on a surface thereof and the sub-ring includes a slot on a mating surface thereof, wherein the slot and the hole are substantially aligned with one another to receive the locking assembly therethrough and wherein the locking assembly comprises a t-lock comprising, (a) a receiver adapted to receive a key for selectively locking the t-lock; and (b) a t-shaped protrusion extending downwardly from the receiver through the hole of the pan and the slot of the sub-ring to secure the pan to the sub-ring; wherein the t-shaped protrusion has a first portion and a second portion perpendicular to the first portion and to the pan, the second portion serving as the stop;

wherein the receiver is in communication with the t-shaped protrusion such that t-shaped protrusion is substantially perpendicular to the slot of the sub-ring when in the locked position and substantially aligned with the slot of the sub-ring when in the unlocked position such that the t-lock may be removed therefrom.

16. The security barrier assembly of claim 1, wherein the pan includes a substantially vertical sidewall having a hole therethrough for receiving at least one of the first and second locking assemblies.

17. The security barrier assembly of claim 16, the locking assembly comprises a removable lock comprising, (a) a receiver configured to receive a key for selectively locking and unlocking the removable lock; and (b) a pin extending horizontally from the receiver through the hole in the vertical side surface of the pan, the pin serving as the stop.

18. The security barrier assembly of claim 16, wherein the locking assembly comprises a hasp lock comprising, (a) a ring coupled to the sidewall of the pan and adapted to receive a padlock;

(b) a plate hingedly coupled to side surface of the pan and including a slot configured to receive the ring therethrough; and (c) a pin coupled to the plate and inserted through the hole of the vertical sidewall of the pan, the pin serving as the stop;

wherein the hasp lock is selectively unlocked by removing the padlock such that the plate freely rotates about a horizontal axis thereby pulling the pin out of the hole of the vertical side of the pan.

19. The security barrier system of claim 1, wherein the sub-ring is affixed to the manhole by an adhesive.

20. The security barrier system of claim 19, wherein the adhesive is a two-part epoxy.

21. A barrier system for a manhole bordered by an outer ring and an access shaft extending downwardly therefrom, the barrier system comprising:

a continuous sub-ring located in and extending completely around an inner surface of the manhole, the sub-ring having a lip extending inwardly from an at least generally vertically extending surface thereof;

a pan having a bottom surface, a sidewall extending upwardly from the bottom surface, and a lip extending outwardly from the sidewall, wherein the lip is supported on the lip of the sub-ring;

a manhole cover mounted in the manhole over the pan in a spaced apart relationship relative thereto;

a first locking assembly configured to secure the pan to the sub-ring; and a second locking assembly that is spaced peripherally from the first locking assembly and that is configured to secure the pan to the sub-ring, the first locking assembly and the second locking assembly each including a stop;

wherein the first and second locking assemblies, the sub-ring, the pan, and the manhole cover are positioned relative to one another such that a gap is formed between the sub-ring and the stop of each locking assembly to allow a limited amount of play between the pan and the sub-ring such that the pan may be lifted a sufficient amount, as defined by the gap, to release liquids trapped in the manhole while the manhole cover is mounted in the manhole and while the first and second locking assemblies remain in a locked state.

22. The barrier system of claim 21, wherein at least one of the first and second locking assemblies comprises a releasable lock that positively couples the pan to the sub-ring.

23. The barrier system of claim 21, wherein at least one of the locking assemblies comprises a device that extends beyond the sidewall of the pan at a location beneath the lip on the sub-ring so as to prevent the pan from being lifted away from the sub-ring.

24. The security barrier assembly of claim 21, wherein the sub-ring is affixed to an inner wall of the manhole below the outer ring thereof and has a substantially vertical outer surface, and wherein the sub-ring is formed from a plurality of arcuate segments that are mounted in the manhole independently of one another with any gaps between the segments being filled in to form the continuous sub-ring.

25. The security barrier system of claim 1, wherein the sub-ring comprises a one-piece, hollow structure that completely surrounds the inner surface of the manhole.

26. The security barrier system of 13, wherein any gaps between the segments are filled in to provide a continuous structure.

27. A security barrier system for attachment to a manhole bordered by an outer ring for and a shaft extending downwardly therefrom, the barrier assembly comprising:

a one-piece, hollow sub-ring affixed to an inner surface of the manhole at or below the outer ring of the manhole and extending completely around the inner surface of the manhole, the sub-ring having a hole through a center thereof;

a pan at least partially covering the hole of the sub-ring and being secured to the sub-ring;

a manhole cover mounted in the manhole over the pan in a spaced apart relationship relative thereto; and a locking assembly that releasably locks the pan to the sub-ring, the locking assembly including a stop; and wherein the locking assembly, the manhole cover, the sub-ring, and the pan are configured such that, when the locking assembly is engaged to thereby lock the pan to the sub-ring and the manhole cover is mounted in place over the pan, a gap is formed between the sub-ring and the stop of the lock such that the pan can move upwardly a limited amount with respect to the sub-ring by an amount, as defined by the gap, that is sufficient to allow for the release of liquids from the manhole from below in a back-up situation.

28. The security barrier system of claim 27, wherein the sub-ring is affixed to the manhole by an adhesive.

29. The security barrier system of claim 2, wherein the inwardly-extending circumferentially disposed lip comprises a number of circumferentially spaced tabs.

30. The security barrier system of claim 7, wherein the bolt is an eye-bolt, and wherein when a head of the eye-bolt is aligned with the slot, the pan is capable of movement over the head of the eye-bolt to either place the pan onto the sub-ring or remove the pan from the sub-ring, ring, and wherein the head of the eye-bolt is at least generally perpendicular to the slot, the pan is restricted from movement over the head of the eye-bolt.

31. The security barrier system of claim 30, further comprising a padlock removably received through the head of the eye-bolt to prevent the pan from being moved over the head.

32. The security barrier system of claim 11, wherein the plurality of apertures have a diameter of no greater than 1/16 of an inch.

33. The security barrier of claim 13, wherein an adhesive is applied between the plurality of arcuate segments to provide a contiguous surface.

* * * * *